US008683714B2

(12) United States Patent
Cinar et al.

(10) Patent No.: US 8,683,714 B2
(45) Date of Patent: Apr. 1, 2014

(54) DRYER COMPRISING A DRYNESS SENSOR

(75) Inventors: Levent Cinar, Istanbul (TR); Arif Ozarslan, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 350 days.

(21) Appl. No.: 13/142,990

(22) PCT Filed: Dec. 9, 2009

(86) PCT No.: PCT/EP2009/066664

§ 371 (c)(1),
(2), (4) Date: Sep. 27, 2011

(87) PCT Pub. No.: WO2010/076131

PCT Pub. Date: Jul. 8, 2010

(65) Prior Publication Data

US 2012/0000276 A1 Jan. 5, 2012

(30) Foreign Application Priority Data

Dec. 30, 2008 (TR) ..... A 2008/10011

(51) Int. Cl.
*F26B 19/00* (2006.01)
*G01N 5/02* (2006.01)

(52) U.S. Cl.
USPC ..... 34/528; 34/550; 73/73

(58) Field of Classification Search
USPC ..... 34/425, 527, 528, 550; 68/19.2; 73/73
See application file for complete search history.

(56) References Cited

U.S. PATENT DOCUMENTS

| | | | | | |
|---|---|---|---|---|---|
| 3,411,219 | A * | 11/1968 | Bartholomew | ..... | 34/534 |
| 3,593,571 | A * | 7/1971 | Wiechert | ..... | 73/73 |
| 4,477,982 | A * | 10/1984 | Cotton | ..... | 34/550 |
| 6,941,678 | B2 * | 9/2005 | Park | ..... | 34/528 |
| 7,975,400 | B2 * | 7/2011 | Dittmer et al. | ..... | 34/528 |
| 2004/0211083 | A1 * | 10/2004 | Park | ..... | 34/528 |
| 2005/0125910 | A1 * | 6/2005 | Guinibert et al. | ..... | 8/158 |
| 2006/0248746 | A1 * | 11/2006 | Dittmer et al. | ..... | 34/534 |

* cited by examiner

*Primary Examiner* — Hezron E Williams
*Assistant Examiner* — Nathaniel Kolb
(74) *Attorney, Agent, or Firm* — Venable, Campillo, Logan & Meaney PC

(57) ABSTRACT

The present invention relates to a dryer (1) comprising a drum (2) which is rotated around its own horizontal axis, a bulkhead (3) which has an opening (4) that enables the laundry to be loaded into the drum (2) and to be unloaded therefrom, a fixing surface (6) which is fixed to the bulkhead (3) and which has at least two apertures (9), and at least two electrodes (5) which are disposed into the apertures (9) and which provide dryness sensing to be performed.

12 Claims, 3 Drawing Sheets

DRYER COMPRISING A DRYNESS SENSOR

Figure 1:
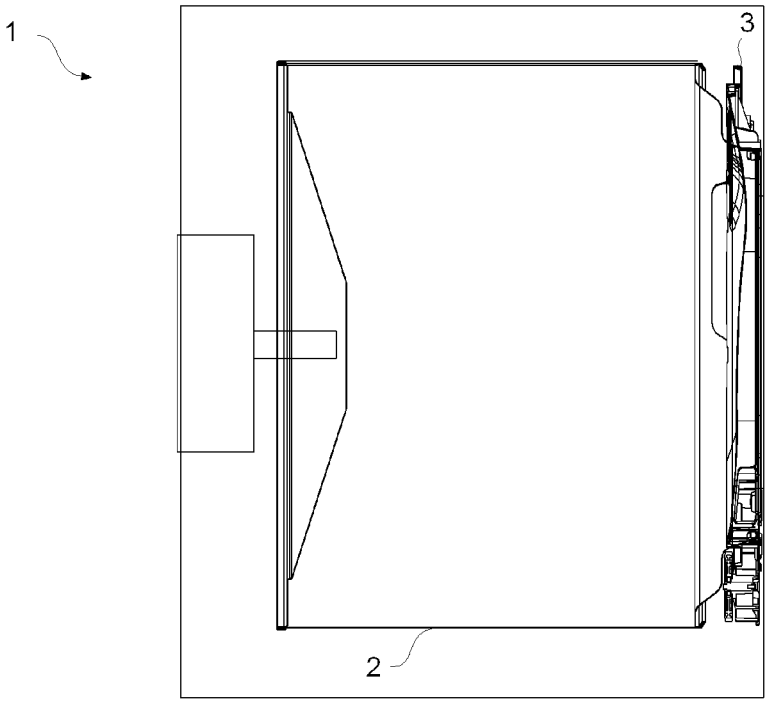

The present invention relates to a dryer comprising dryness sensor.

As is known, in dryers, various embodiments for sensing the dryness of laundry are available. One of these embodiments is based on the principle that at least two electrodes are disposed to a point where the laundry will contact during the drying process and that a current bridge is formed between the electrodes when the damp laundry contacts both electrodes simultaneously. The resistance occurring between the two electrodes by the contact of the laundry to the two electrodes is measured and dryness sensing is performed.

In the state of the art, in order to increase the measurement efficiency, various embodiments have been developed relating to where these conductive elements used in dryness sensing will be disposed inside the dryer and how they will be assembled.

In the state of the art embodiment, U.S. Pat. No. 3,593,571, a dryer wherein the electrodes are fastened by means of clip means is explained.

Another state of the art embodiment is explained in the European Patent Application No EP1473402. In this embodiment, the electrodes are mounted on a sensor body and the sensor body is secured to the front bulkhead of the dryer by mechanical connection methods such as screw and detent.

In another state of the art embodiment, U.S. Pat. No. 4,899,464, a dryer that comprises electrodes which are snap-fittingly seated in the housings formed on the front bulkhead is explained.

Another state of the art document is U.S. Pat. No. 5,940,986. In this document, a dryer wherein the electrodes are embedded on the plastic exhaust vent cover by heat staking is explained.

However, in these state of the art embodiments, due to fluffs of laundry being accumulated between the electrodes in the course of time and also due to the humid environment, a transmission line is formed between the electrodes and this situation adversely affects the measurement precision.

The aim of the present invention is the realization of a dryer wherein the dryness sensing precision is increased.

The dryer realized in order to attain the aim of the present invention is explicated in the attached claims.

The dryer of the present invention comprises a barrier that is located at the back side, which does not face the drum, of a fixing surface, whereon the electrodes are fixed, and that is located between the electrodes. The barrier extends along the electrodes and thus, the fluffs jammed in the back side of the fixing surface are prevented from forming a transmission line between the electrodes.

In different embodiments of the present invention, the barrier is produced as a single piece with the fixing surface or after the barrier and the fixing surface are produced separately, the barrier is assembled on the fixing surface.

In the preferred embodiment of the present invention, the barrier portion remaining between the terminals is higher than its portion between the electrodes. Thus, particularly the portion wherein the terminals are situated is provided to be more protected against the problems that can occur as a result of fluff accumulation.

The model embodiments that relate to the dryer realized in order to attain the aim of the present invention are illustrated in the attached figures, where:

FIG. 1—is the side schematic view of a dryer.

Figure 2:
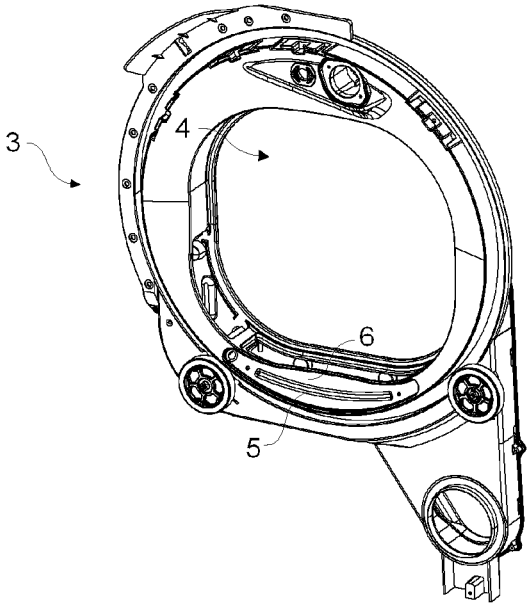

FIG. 2—is the perspective view of the bulkhead.

Figure 3:
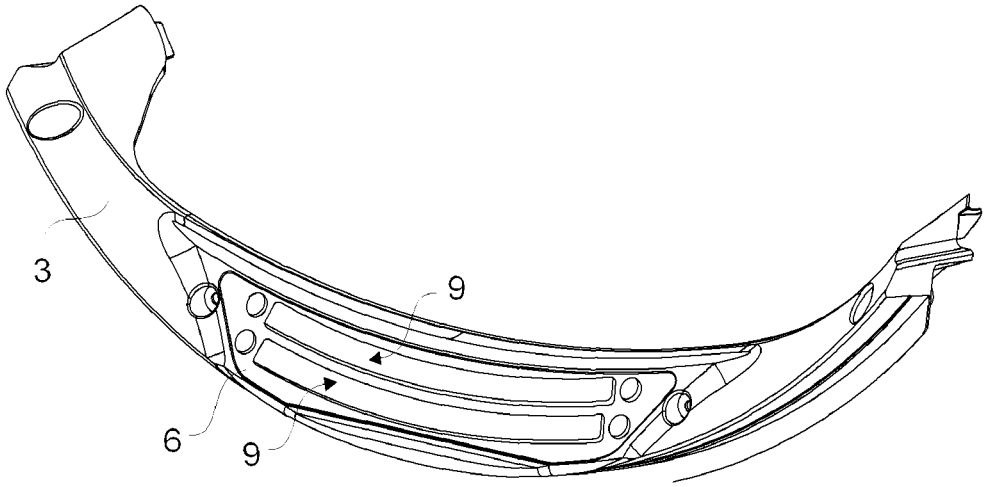

FIG. 3—is the detailed front view of the bulkhead and the fixing surface.

Figure 4:
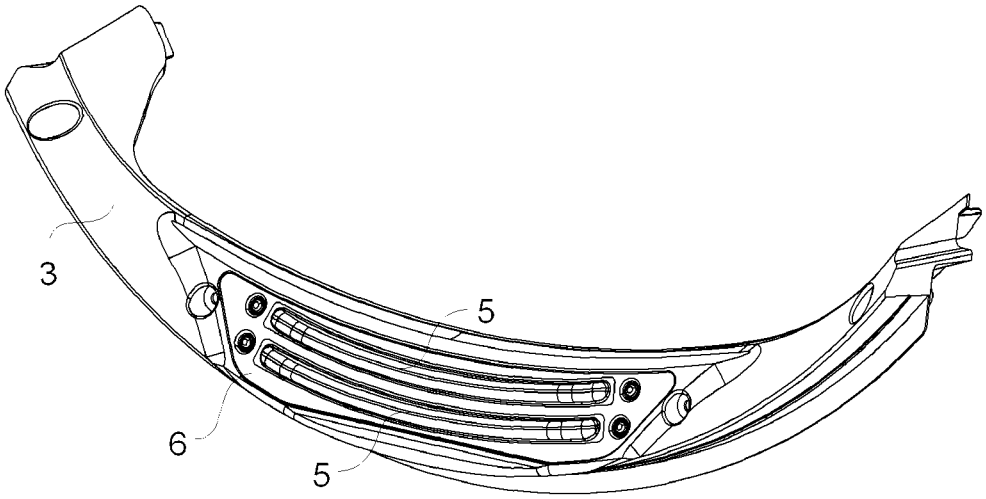

FIG. 4—is the detailed front view of the bulkhead, the fixing surface and the electrodes.

Figure 5:
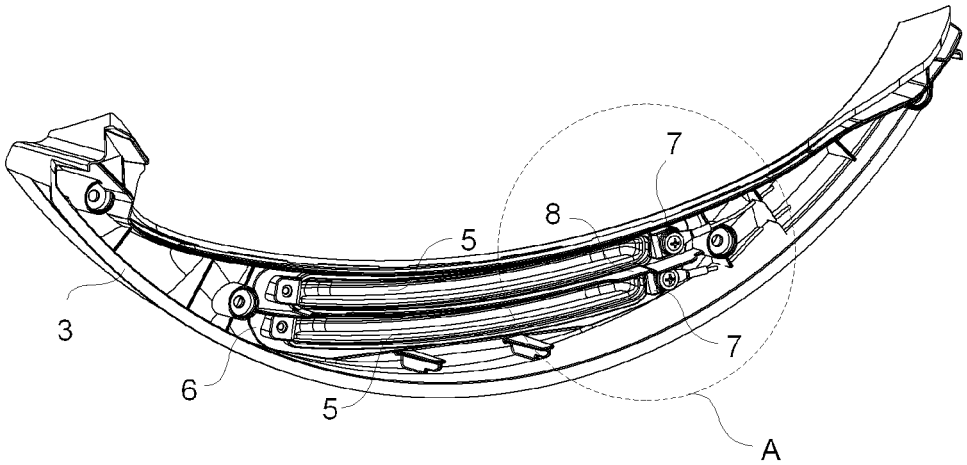

FIG. 5—is the detailed rear view of the bulkhead, the fixing surface and the electrodes.

Figure 6:
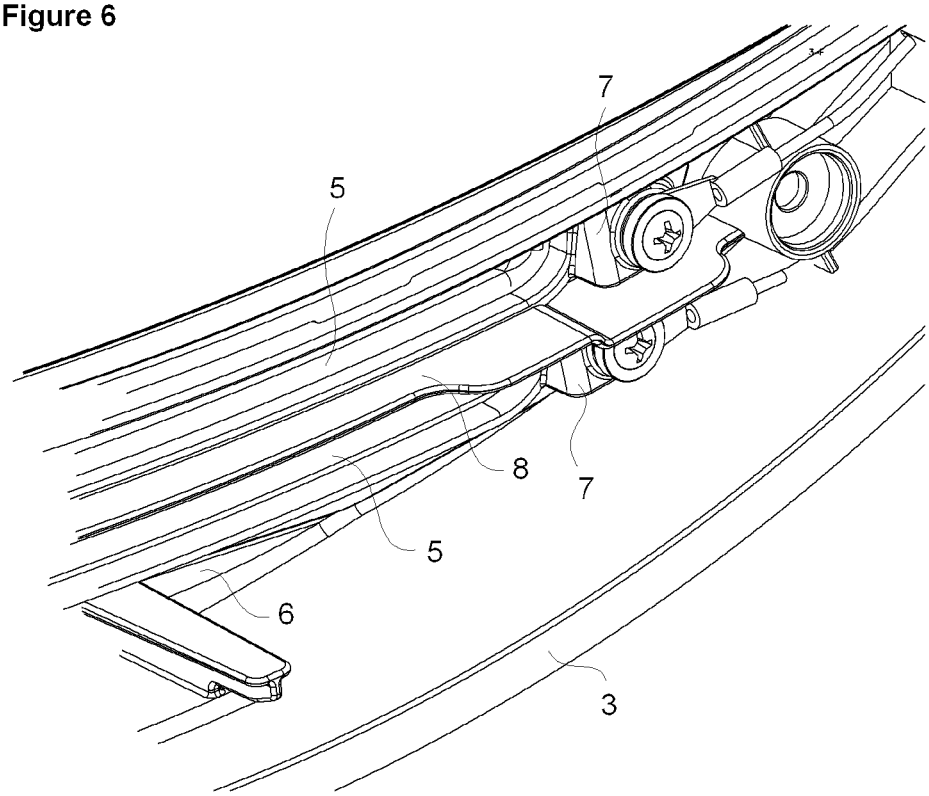

FIG. 6—is the view of detail A in FIG. 5.

The elements illustrated in the figures are numbered as follows:

1. Dryer
2. Drum
3. Bulkhead
4. Opening
5. Electrode
6. Fixing surface
7. Terminal
8. Barrier
9. Aperture The dryer (1) of the present invention comprises a drum (2) rotated around its own horizontal axis, a bulkhead (3) having an opening (4) that enables the laundry to be loaded into the drum (2) and to be unloaded therefrom, a fixing surface (6) which is fixed to the bulkhead (3) and which has at least two apertures (9), at least two electrodes (5) which are disposed into the apertures (9) and which provide dryness sensing to be performed, and at least two terminals (7) which are located at the fixing surface (6) back side that does not face the drum (2) and which provide the connection of the electrodes (5) with the sensing circuit to enable sensing (FIGS. 1 to 5).

The dryer (1), furthermore, comprises a barrier (8) which is located at the fixing surface (6) back side that does not face the drum (2) and which extends longitudinally between the electrodes (5) (FIG. 5 and FIG. 6). Thus, the fluffs accumulated at the electrode (5) back faces, which are open, are prevented from forming a transmission line between the two electrodes (5) and hence, the dryness sensing precision is increased.

In an embodiment of the present invention, the barrier (8) is produced as a single piece with the fixing surface (6). The electrodes (5) are mounted on the fixing surface (6) such that the barrier (8) will remain between them. Thus, the barrier (8) is positioned between the electrodes (5) without the need of an additional assembly process.

In another embodiment of the present invention, after the barrier (8) and the fixing surface (6) are produced separately, the barrier (8) is assembled on the fixing surface (6). Thus, by using barrier (8) and fixing surface (6) that are easy to produce, the dryness sensing efficiency is enabled to be increased.

In an embodiment of the present invention, the barrier (8) extends between the terminals (7). In this embodiment, the height of the barrier (8) portion remaining between the terminals (7) is preferably more than the height of its portion between the electrodes (5) (FIG. 5 and FIG. 6). Thus, the problems that can be confronted due to fluff accumulation particularly in the area wherein the terminals are situated are prevented.

It is to be understood that the present invention is not limited to the embodiments disclosed above and a skilled person in the art can easily introduce different embodiments. These should be considered within the scope of the protection postulated by the claims of the present invention.

The invention claimed is:

1. A dryer (1) comprising —a drum (2) which is rotated around its own horizontal axis, —a bulkhead (3) which has an opening (4) that enables laundry to be loaded into the drum (2) and to be unloaded therefrom, —a fixing surface (6) which is fixed to the bulkhead (3) and which has at least two apertures (9), —at least two electrodes (5) which are disposed into the apertures (9) and which provide dryness sensing to be performed, and —at least two terminals (7) which are located at the fixing surface (6) back side that does not face the drum (2) and which provide the connection of the electrodes (5) with the sensing circuit to enable sensing, characterized by a barrier (8) which is located at the fixing surface (6) back side that does not face the drum (2), and which extends longitudinally between the electrodes (5) and which prevents the fluffs accumulated at the electrode (5) back faces that are open from forming a transmission line between the two electrodes (5).

2. A dryer (1) as in claim 1, characterized by the barrier (8) which is produced as a single piece with the fixing surface (6).

3. A dryer (1) as in claim 2, characterized by the barrier (8) which extends between the terminals (7).

4. A dryer (1) as in claim 3, characterized by the barrier (8), wherein the height of its portion remaining between the terminals (7) is more than the height of its portion between the electrodes (5).

5. A dryer (1) as in claim 2, characterized by the barrier (8), wherein the height of its portion remaining between the terminals (7) is more than the height of its portion between the electrodes (5).

6. A dryer (1) as in claim 1, characterized by the barrier (8) which, after being produced separately from the fixing surface (6), is assembled on the fixing surface (6).

7. A dryer (1) as in claim 6, characterized by the barrier (8) which extends between the terminals (7).

8. A dryer (1) as in claim 7, characterized by the barrier (8), wherein the height of its portion remaining between the terminals (7) is more than the height of its portion between the electrodes (5).

9. A dryer (1) as in claim 6, characterized by the barrier (8), wherein the height of its portion remaining between the terminals (7) is more than the height of its portion between the electrodes (5).

10. A dryer (1) as in claim 1, characterized by the barrier (8) which extends between the terminals (7).

11. A dryer (1) as in claim 10, characterized by the barrier (8), wherein the height of its portion remaining between the terminals (7) is more than the height of its portion between the electrodes (5).

12. A dryer (1) as in claim 1, characterized by the barrier (8), wherein the height of its portion remaining between the terminals (7) is more than the height of its portion between the electrodes (5).

* * * * *